US008931717B2

(12) United States Patent
Watson et al.

(10) Patent No.: US 8,931,717 B2
(45) Date of Patent: Jan. 13, 2015

(54) NOZZLE DESIGN FOR HIGH TEMPERATURE ATTEMPERATORS

(71) Applicant: Control Components, Inc., Rancho Santa Margarita, CA (US)

(72) Inventors: Daniel Allen Lee Watson, Rancho Santa Margarita, CA (US); Raymond Richard Newton, Trabuco Canyon, CA (US); Stephen Gerald Freitas, Mission Viejo, CA (US); Kevin Naziri, Mission Viejo, CA (US)

(73) Assignee: Control Components, Inc., Rancho Santa Margarita, CA (US)

( * ) Notice: Subject to any disclaimer, the term of this patent is extended or adjusted under 35 U.S.C. 154(b) by 139 days.

(21) Appl. No.: 13/644,049

(22) Filed: Oct. 3, 2012

(65) Prior Publication Data

US 2014/0091485 A1 Apr. 3, 2014

(51) Int. Cl.
*F22G 5/12* (2006.01)

(52) U.S. Cl.
CPC ..... *F22G 5/123* (2013.01); *Y10S 261/13* (2013.01)
USPC ..... 239/439; 261/66; 261/DIG. 13; 239/443; 137/542

(58) Field of Classification Search
CPC ..... F22G 5/123
USPC ..... 261/66; 239/439; 122/487
See application file for complete search history.

(56) References Cited

U.S. PATENT DOCUMENTS 355,250 A 12/1886 Blass
1,252,254 A * 1/1918 Fisher ..... 123/294
1,313,971 A 8/1919 Wilson
1,486,156 A 3/1924 Needham
1,893,298 A 1/1933 Moore
2,127,188 A 8/1938 Schellin et al.
2,155,986 A 4/1939 Wheaton
2,277,811 A 3/1942 Ashley et al.
2,313,994 A * 3/1943 Grant ..... 239/440
2,323,464 A 7/1943 Glessner
2,355,458 A 8/1944 Mastenbrook
2,801,087 A 7/1957 Hawk
3,220,710 A 11/1965 Forster
3,286,935 A 11/1966 Corlett et al.
3,331,590 A 7/1967 Battenfeld et al.
3,332,401 A 7/1967 Lustenader
3,434,500 A 3/1969 Burrows (Continued)

FOREIGN PATENT DOCUMENTS

DE 3713726 A1 11/1988
EP 1180627 A1 2/2004

(Continued)

*Primary Examiner* — Duane Smith
*Assistant Examiner* — Stephen Hobson
(74) *Attorney, Agent, or Firm* — Stetina Brunda Garred & Brucker

(57) ABSTRACT

An improved spray nozzle assembly for use in a steam desuperheating device that is adapted to spray cooling water into a flow of superheated steam. The nozzle assembly is of simple construction with relatively few components, and thus requires a minimal amount of maintenance. In addition, the nozzle assembly is specifically configured to, among other things, prevent thermal shock to prescribed internal structural components thereof, to prevent "sticking" of a valve element thereof, and to create a substantially uniformly distributed spray of cooling water for spraying into a flow of superheated steam in order to reduce the temperature of the steam.

20 Claims, 5 Drawing Sheets

(56) References Cited

U.S. PATENT DOCUMENTS

| | | | | | |
|---|---|---|---|---|---|
| 3,589,621 | A | * | 6/1971 | Bradley | 239/526 |
| 3,655,164 | A | * | 4/1972 | Hayes | 251/347 |
| 3,732,851 | A | | 5/1973 | Self | |
| 3,917,221 | A | | 11/1975 | Kubota et al. | |
| 4,017,055 | A | | 4/1977 | Daughetee et al. | |
| 4,060,199 | A | * | 11/1977 | Brune et al. | 239/488 |
| 4,071,586 | A | | 1/1978 | Seger | |
| 4,082,224 | A | * | 4/1978 | Mangus | 239/453 |
| 4,130,611 | A | | 12/1978 | Brand | |
| 4,179,069 | A | * | 12/1979 | Knapp et al. | 239/125 |
| 4,396,156 | A | * | 8/1983 | Southworth et al. | 239/526 |
| 4,442,047 | A | | 4/1984 | Johnson et al. | |
| 4,479,908 | A | | 10/1984 | Arbeille et al. | |
| 4,512,520 | A | * | 4/1985 | Schoonover | 239/440 |
| 4,651,931 | A | * | 3/1987 | Hans et al. | 239/533.9 |
| 4,899,699 | A | * | 2/1990 | Huang et al. | 123/73 C |
| 4,925,111 | A | * | 5/1990 | Foertsch et al. | 239/533.12 |
| 4,944,460 | A | | 7/1990 | Steingass | |
| 4,991,780 | A | | 2/1991 | Kannan et al. | |
| 5,005,605 | A | | 4/1991 | Kueffer et al. | |
| 5,044,561 | A | * | 9/1991 | Holzgrefe | 239/487 |
| 5,058,549 | A | * | 10/1991 | Hashimoto et al. | 123/298 |
| 5,336,451 | A | | 8/1994 | Lovick | |
| 5,364,033 | A | * | 11/1994 | Cedoz et al. | 239/526 |
| 5,385,121 | A | | 1/1995 | Feiss | |
| 5,465,906 | A | * | 11/1995 | Hans | 239/489 |
| 5,607,626 | A | | 3/1997 | Kunkle et al. | |
| 5,785,257 | A | * | 7/1998 | Furuya et al. | 239/585.4 |
| 6,062,499 | A | * | 5/2000 | Nakamura et al. | 239/585.1 |
| 6,619,568 | B2 | | 9/2003 | Kunkle et al. | |
| 6,691,929 | B1 | | 2/2004 | Sherikar | |
| 6,746,001 | B1 | * | 6/2004 | Sherikar | 261/62 |
| 6,764,032 | B2 | * | 7/2004 | Bulgatz et al. | 239/585.1 |
| 6,823,833 | B2 | * | 11/2004 | Ismailov | 123/299 |
| 7,028,976 | B2 | * | 4/2006 | Bachmann et al. | 251/126 |
| 7,028,994 | B2 | | 4/2006 | Sherikar | |
| 7,172,175 | B2 | | 2/2007 | Vicars | |
| 7,370,817 | B2 | | 5/2008 | Tilton et al. | |
| 7,481,058 | B2 | | 1/2009 | Fukuda et al. | |
| 7,654,509 | B2 | | 2/2010 | Freitas et al. | |
| 7,802,376 | B2 | | 9/2010 | Hüttlin et al. | |
| 7,850,149 | B2 | * | 12/2010 | Sherikar et al. | 261/62 |
| 7,891,374 | B2 | | 2/2011 | Vicars | |
| 2005/0194702 | A1 | | 9/2005 | Sherikar | |
| 2006/0125126 | A1 | | 6/2006 | Sherikar et al. | |

FOREIGN PATENT DOCUMENTS

| | | | |
|---|---|---|---|
| EP | 1992465 | A2 | 11/2008 |
| JP | 2011519726 | T | 7/2011 |
| WO | 2009136967 | | 11/2009 |

* cited by examiner

NOZZLE DESIGN FOR HIGH TEMPERATURE ATTEMPERATORS

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

1. Field of the Invention

The present invention pertains generally to steam desuperheaters or attemperators and, more particularly, to a uniquely configured spray nozzle assembly for a steam desuperheating or attemperator device. The nozzle assembly is specifically adapted to, among other things, prevent thermal shock to prescribed internal structural components thereof, to prevent "sticking" of a valve stem thereof, and to create a substantially uniformly distributed spray of cooling water for spraying into a flow of superheated steam in order to reduce the temperature of the steam.

2. Description of the Related Art

Many industrial facilities operate with superheated steam that has a higher temperature than its saturation temperature at a given pressure. Because superheated steam can damage turbines or other downstream components, it is necessary to control the temperature of the steam. Desuperheating refers to the process of reducing the temperature of the superheated steam to a lower temperature, permitting operation of the system as intended, ensuring system protection, and correcting for unintentional deviations from a prescribed operating temperature set point. Along these lines, the precise control of final steam temperature is often critical for the safe and efficient operation of steam generation cycles.

A steam desuperheater or attemperator can lower the temperature of superheated steam by spraying cooling water into a flow of superheated steam that is passing through a steam pipe. By way of example, attemperators are often utilized in heat recovery steam generators between the primary and secondary superheaters on the high pressure and the reheat lines. In some designs, attemperators are also added after the final stage of superheating. Once the cooling water is sprayed into the flow of superheated steam, the cooling water mixes with the superheated steam and evaporates, drawing thermal energy from the steam and lowering its temperature.

A popular, currently known attemperator design is a probe style attemperator which includes one or more nozzles or nozzle assemblies positioned so as to spray cooling water into the steam flow in a direction generally along the axis of the steam pipe. In many applications, the steam pipe is outfitted with an internal thermal liner which is positioned downstream of the spray nozzle attemperator. The liner is intended to protect the high temperature steam pipe from the thermal shock that would result from any impinging water droplets striking the hot inner surface of the steam pipe itself.

One of the most commonly encountered problems in those systems integrating an attemperator is the addition of unwanted water to the steam line or pipe as a result of the improper operation of the attemperator, or the inability of the nozzle assembly of the attemperator to remain leak tight. The failure of the attemperator to control the water flow injected into the steam pipe often results in damaged hardware and piping from thermal shock, and in severe cases has been known to erode piping elbows and other system components downstream of the attemperator. Along these lines, water buildup can further cause erosion, thermal stresses, and/or stress corrosion cracking in the liner of the steam pipe that may lead to its structural failure.

In addition, the service requirements in many applications are extremely demanding on the attemperator itself, and often result in its failure. More particularly, in many applications, various structural features of the attemperator, including the nozzle assembly thereof, will remain at elevated steam temperatures for extended periods without spray water flowing through it, and thus will be subjected to thermal shock when quenched by the relatively cool spray water. Along these lines, typical failures include spring breakage in the nozzle assembly, and the sticking of the valve stem thereof. Further, in probe style attemperators wherein the spray nozzle(s) reside in the steam flow, such cycling often results in fatigue and thermal cracks in critical components such as the nozzle holder and the nozzle itself. Thermal cycling, as well as the high velocity head of the steam passing the attemperator, can also potentially lead to the loosening of the nozzle assembly which may result in an undesirable change in the orientation of its spray angle.

With regard to the functionality of any nozzle assembly of an attemperator, if the cooling water is sprayed into the superheated steam pipe as very fine water droplets or mist, then the mixing of the cooling water with the superheated steam is more uniform through the steam flow. On the other hand, if the cooling water is sprayed into the superheated steam pipe in a streaming pattern, then the evaporation of the cooling water is greatly diminished. In addition, a streaming spray of cooling water will typically pass through the superheated steam flow and impact the interior wall or liner of the steam pipe, resulting in water buildup which is undesirable for the reasons set forth above. However, if the surface area of the cooling water spray that is exposed to the superheated steam is large, which is an intended consequence of very fine droplet size, the effectiveness of the evaporation is greatly increased. Further, the mixing of the cooling water with the superheated steam can be enhanced by spraying the cooling water into the steam pipe in a uniform geometrical flow pattern such that the effects of the cooling water are uniformly distributed throughout the steam flow. Conversely, a non-uniform spray pattern of cooling water will result in an uneven and poorly controlled temperature reduction throughout the flow of the superheated steam. Along these lines, the inability of the cooling water spray to efficiently evaporate in the superheated steam flow may also result in an accumulation of cooling water within the steam pipe. The accumulation of this cooling water will eventually evaporate in a non-uniform heat exchange between the water and the superheated steam, resulting in a poorly controlled temperature reduction.

Various desuperheater devices have been developed in the prior art in an attempt to address the aforementioned needs. Such prior art devices include those which are disclosed in Applicant's U.S. Pat. No. 6,746,001 (entitled Desuperheater Nozzle), U.S. Pat. No. 7,028,994 (entitled Pressure Blast Pre-Filming Spray Nozzle), U.S. Pat. No. 7,654,509 (entitled Desuperheater Nozzle), and U.S. Pat. No. 7,850,149 (entitled Pressure Blast Pre-Filming Spray Nozzle), the disclosures of which are incorporated herein by reference. The present invention represents an improvement over these and other prior art solutions, and provides a nozzle assembly for spraying cooling water into a flow of superheated steam that is of simple construction with relatively few components, requires a minimal amount of maintenance, and is specifically adapted to, among other things, prevent thermal shock to prescribed internal structural components thereof, to prevent "sticking" of a valve stem thereof, and to create a substantially uniformly distributed spray of cooling water for spraying into a flow of superheated steam in order to reduce the temperature of the steam. Various novel features of the present invention will be discussed in more detail below.

BRIEF SUMMARY OF THE INVENTION

In accordance with the present invention, there is provided an improved spray nozzle assembly for an attemperator which is operative to spray cooling water into a flow of superheated steam in a generally uniformly distributed spray pattern. The nozzle assembly comprises a nozzle housing and a valve element which is movably interfaced to the nozzle housing. The valve element, also commonly referred to as a valve pintle or a valve plug, extends through the nozzle housing and is axially movable between a closed position and an open (flow) position. The nozzle housing defines a generally annular flow passage. The flow passage itself comprises three identically configured, arcuate flow passage sections, each of which spans an interval of approximately 120°. One end of each of the flow passage sections extends to a first (top) end of the nozzle housing. The opposite end of each of the flow passage sections fluidly communicates with a fluid chamber which is also defined by the nozzle housing and extends to a second (bottom) end of the nozzle housing which is disposed in opposed relation to the first end thereof. A portion of the second end of the nozzle housing which circumvents the fluid chamber defines a seating surface of the nozzle assembly. The nozzle housing further defines a central bore which extends axially from the first end thereof, and is circumvented by the annular flow passage collectively defined by the separate flow passage sections, i.e., the central bore is concentrically positioned within the flow passage sections. That end of the central bore opposite the end extending to the first end of the nozzle housing terminates at the fluid chamber.

The valve element comprises a valve body or nozzle cone, and an elongate valve stem which is integrally connected to the nozzle cone and extends axially therefrom. The nozzle cone has a tapered outer surface, with the junction between the nozzle cone and the valve stem being defined by a continuous, annular groove or channel formed within the valve element. The valve stem is advanced through the central bore of the nozzle housing. Disposed within the central bore of the nozzle housing is a biasing spring which circumvents a portion of the valve stem, and normally biases the valve element to its closed position.

In the nozzle assembly, cooling water is introduced into each of the flow passage sections at the first end of the nozzle housing, and thereafter flows therethrough into the fluid chamber. When the valve element is in its closed position, a portion of the outer surface of the nozzle cone thereof is seated against the seating surface defined by the nozzle housing, thereby blocking the flow of fluid out of the fluid chamber and hence the nozzle assembly. An increase of the pressure of the fluid beyond a prescribed threshold effectively overcomes the biasing force exerted by the biasing spring, thus facilitating the actuation of the valve element from its closed position to its open position. When the valve element is in its open position, the nozzle cone thereof and the that portion of the nozzle housing defining the seating surface collectively define an annular outflow opening between the fluid chamber and the exterior of the nozzle assembly. The shape of the outflow opening, coupled with the shape of the nozzle cone of the valve element, effectively imparts a conical spray pattern of small droplet size to the fluid flowing from the nozzle assembly. Importantly, fluid flow through the nozzle assembly normally bypasses the central bore, and thus does not directly impinge the biasing spring therein. In one embodiment of the present invention, prescribed portions of the valve stem of the valve element may include grooves formed therein in a prescribed pattern, such grooves being sized, configured and arranged to prevent debris accumulation in the central bore which could otherwise result in the sticking of the valve element during the reciprocal movement thereof between its closed and open positions.

The present invention is best understood by reference to the following detailed description when read in conjunction with the accompanying drawings.

BRIEF DESCRIPTION OF THE DRAWINGS

These, as well as other features of the present invention, will become more apparent upon reference to the drawings wherein.

Common reference numerals are used throughout the drawings and detailed description to indicate like elements.

DETAILED DESCRIPTION OF THE INVENTION

Figure 2:
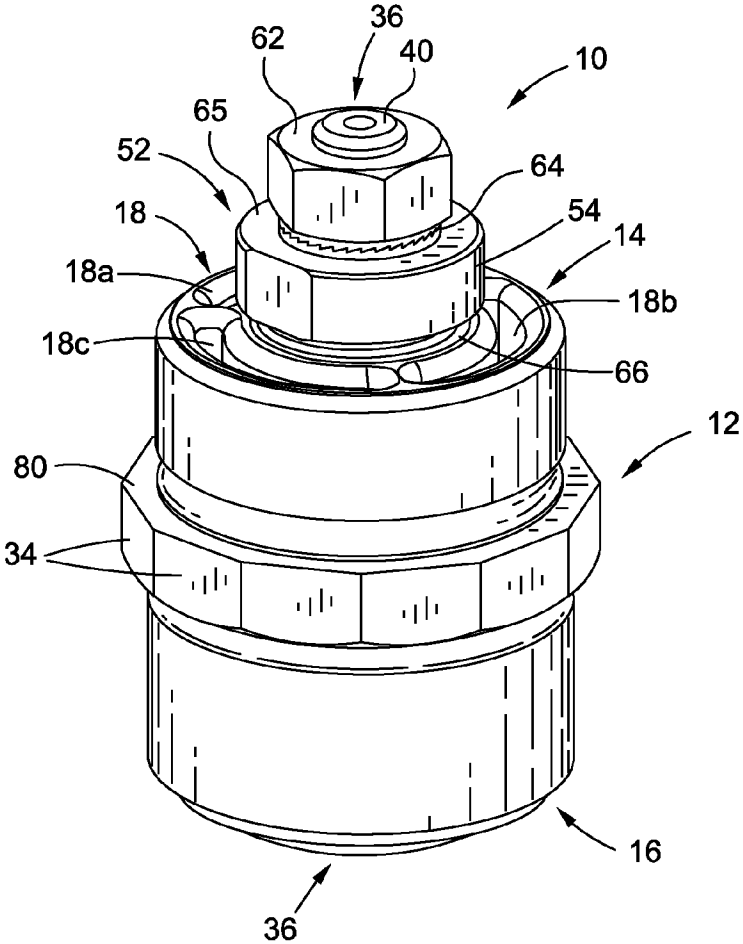
FIG. 2 is a top perspective view of the nozzle assembly shown in FIG. 1.
Figure 1:
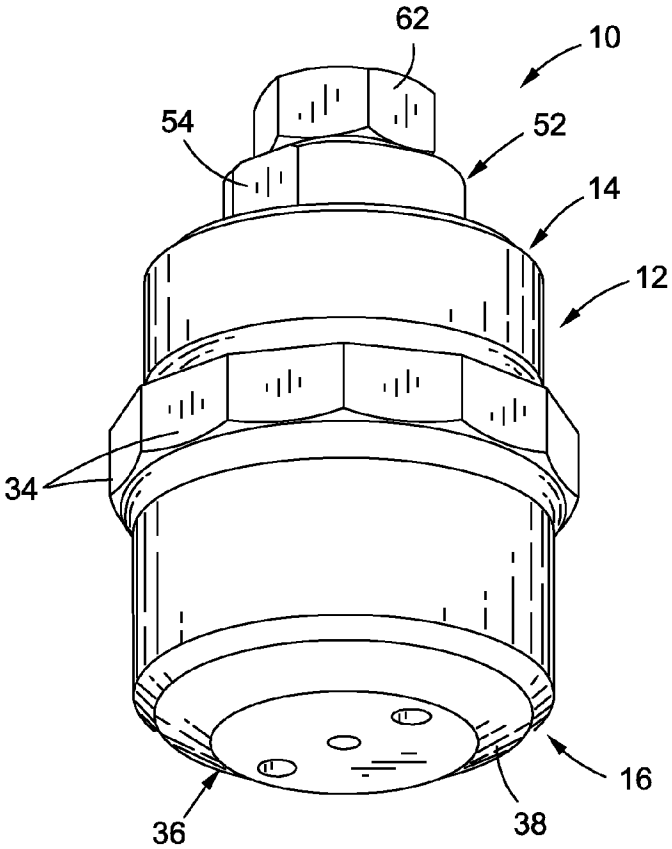
FIG. 1 is a bottom perspective view of a nozzle assembly constructed in accordance with the present invention, depicting the valve element thereof in a closed position.
Figure 4:
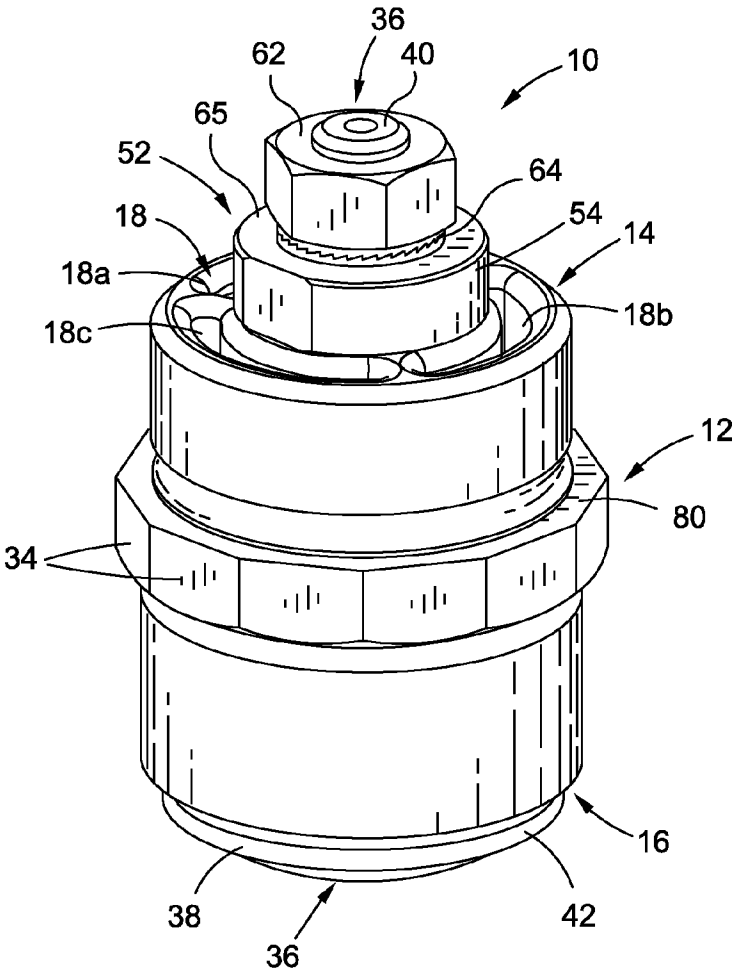
FIG. 4 is a top perspective view of the nozzle assembly shown in FIG. 3.
Figure 5:
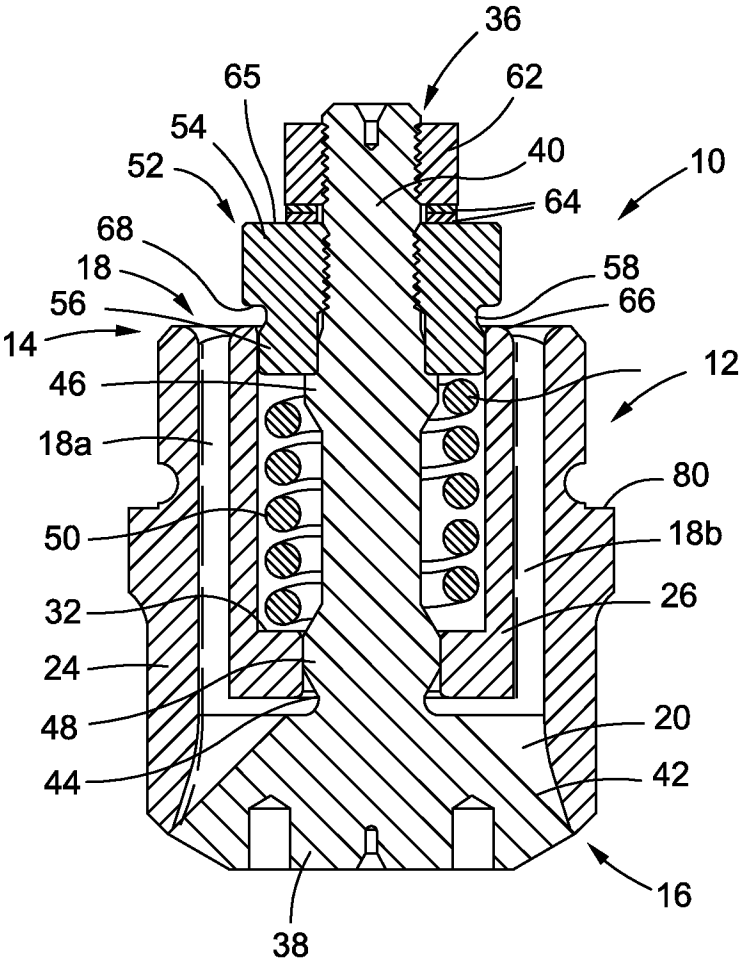
FIG. 5 is a cross-sectional view of the nozzle assembly of the present invention, depicting the valve element thereof in its closed position.

Referring now to the drawings wherein the showings are for purposes of illustrating a preferred embodiment of the present invention only, and not for purposes of limiting the same, FIGS. 1-6 depict a nozzle assembly 10 constructed in accordance with a present invention. In FIGS. 1, 2 and 5, the nozzle assembly 10 is shown in a closed position which will be described in more detail below. Conversely, in FIGS. 3, 4 and 6, the nozzle assembly 10 is shown in an open position which will also be described in more detail below. As indicated above, the nozzle assembly 10 is adapted for integration into a desuperheating device such as, but not necessarily limited to, a probe type attemperator. As will be recognized by those of ordinary skill in the art, the nozzle assembly 10 of present invention may be integrated into any one of a wide variety of different desuperheating devices or attemperators without departing from the spirit and scope of the present invention.

Figure 6:
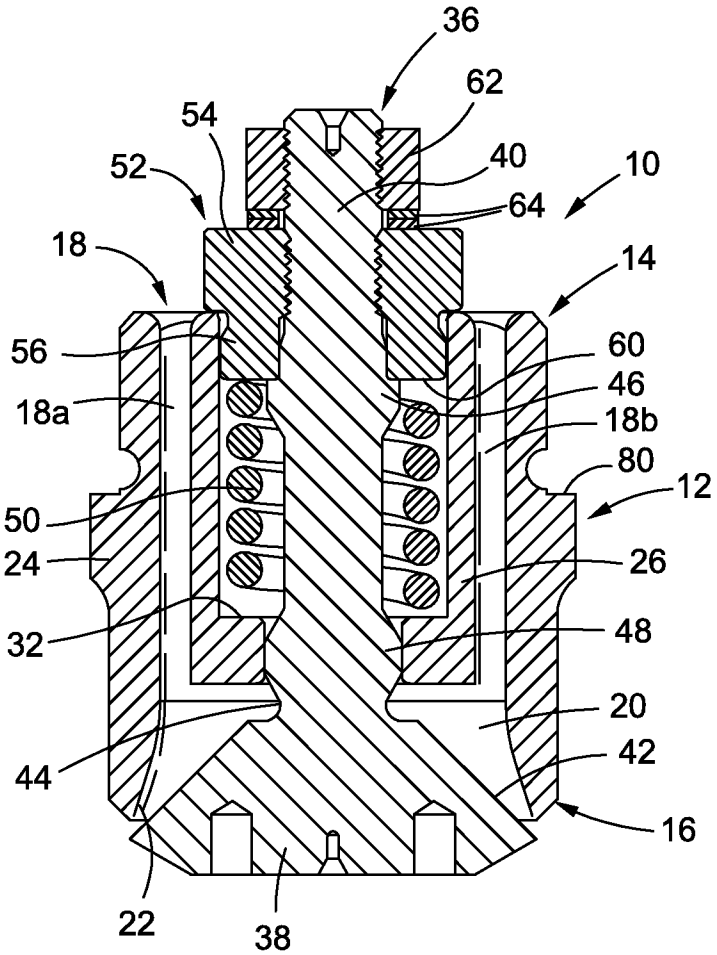
FIG. 6 is a cross-sectional view of the nozzle assembly of the present invention, depicting the valve element thereof in its open position.
Figure 8:
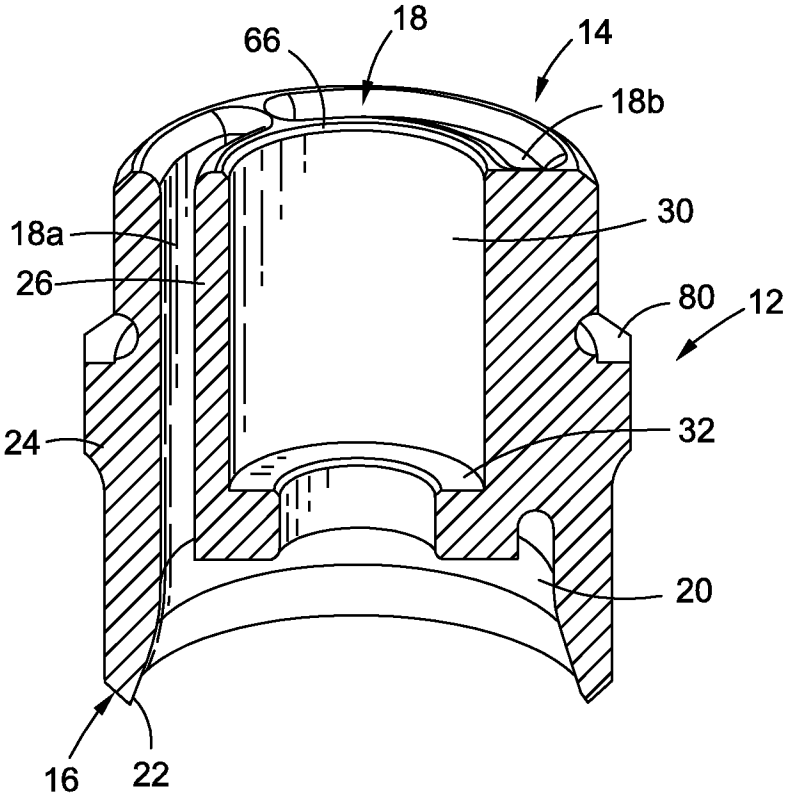
FIG. 8 is a cross-sectional view of the nozzle housing shown in FIG. 7.
Figure 7:
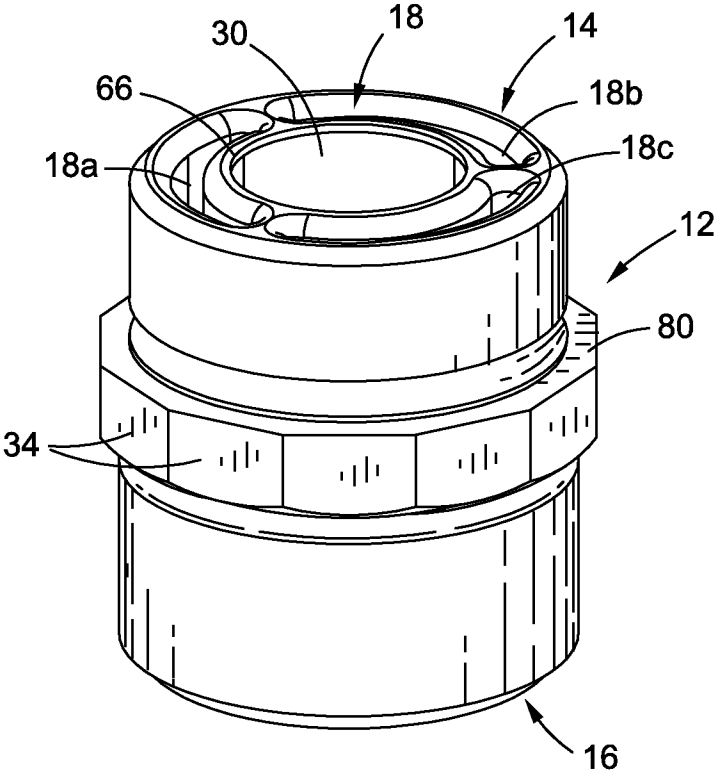
FIG. 7 is a top perspective view of the nozzle housing of the nozzle assembly of the present invention.

The nozzle assembly 10 of the present invention comprises a nozzle housing 12 which is shown with particularity in FIGS. 7 and 8. The nozzle housing 12 has a generally cylindrical configuration and, when viewed from the perspective shown in FIGS. 1-8, defines a first, top end 14 and an opposed second, bottom end 16. The nozzle housing 12 further defines a generally annular flow passage 18. The flow passage 18 comprises three identically configured, arcuate flow passage sections 18*a*, 18*b*, 18*c*, each of which spans an interval of approximately 120°. One end of each of the flow passage sections 18*a*, 18*b*, 18*c* extends to the top end 14 of the nozzle housing 14. The opposite end of each of the flow passage sections 18*a*, 18*b*, 18*c* fluidly communicates with a fluid chamber 20 which is also defined by the nozzle housing 12 and extends to the bottom end 16 thereof. A portion of the bottom end 16 of the nozzle housing 12 which circumvents the fluid chamber 20 defines an annular seating surface 22 of the nozzle housing 12, the use of which will be described in more detail below.

As is most easily seen in FIGS. 5-8, the nozzle housing 12 defines a tubular, generally cylindrical outer wall 24, and a tubular, generally cylindrical inner wall 26 which is concentrically positioned within the outer wall 24. The inner wall 26 is integrally connected to the outer wall 24 by three (3) identically configured spokes 28 of the nozzle housing 12 which are themselves separated from each other by equidistantly spaced intervals of approximately 120°. As best seen in FIG. 8, one end of each of the spokes 28 terminates at the top end 14 of the nozzle housing 12, with the opposite end of each spoke 28 terminating at the fluid chamber 20. The inner wall 26 of the nozzle housing 12 defines a central bore 30 thereof. The central bore 30 extends axially within the nozzle housing 12, with one end of the central bore 30 being disposed at the top end 14, and the opposite end terminating at but fluidly communicating with the fluid chamber 20. Due to the orientation of the central bore 30 within the nozzle housing 12, the same is circumvented by the annular flow passage 18 collectively defined by the separate flow passage sections 18*a*, 18*b*, 18*c*, i.e., the central bore 30 is concentrically positioned within the flow passage sections 18*a*, 18*b*, 18*c*.

As further seen in FIG. 8, the central bore 30 is not of a uniform diameter. Rather, when viewed from the perspective shown in FIG. 8, the inner wall 26 is formed such that the central bore 30 defines a top section which is of a first diameter and a bottom section which is of a second diameter less than the first diameter. As a result, the top and bottom sections of the central bore 30 are separated by a continuous, annular shoulder 32 of the inner wall 26. In the nozzle assembly 10, the flow passage sections 18*a*, 18*b*, 18*c* are each collectively defined by the outer and inner walls 24, 26 and an adjacent pair of the spokes 28, with the fluid chamber 20 being collectively defined by the outer wall 24 and that portion of the inner wall 26 which defines the shoulder 32 thereof. As is most apparent from FIGS. 1-4 and 7, a portion of the outer surface of the outer wall 24 is formed to define a multiplicity of flats 34, the use of which will be described in more detail below. In the nozzle assembly 10, it is contemplated that the nozzle housing 12 having the structural features described above may be fabricated from a direct metal laser sintering (DMLS) process in accordance with the teachings of Applicant's U.S. Patent Publication No. 2009/0183790 entitled Direct Metal Laser Sintered Flow Control Element published Jul. 23, 2009, the disclosure of which is also incorporated herein by reference. Alternatively, the nozzle housing 12 may be fabricated through the use of a die casting process.

The nozzle assembly 10 further comprises a valve element 36 which is moveably interfaced to the nozzle housing 12, and is reciprocally moveable in an axial direction relative thereto between a closed position and an open or flow position. The valve element 36 comprises a valve body or nozzle cone 38, and an elongate valve stem 40 which is integrally connected to the nozzle cone 38 and extends axially therefrom. The nozzle cone 38 defines a tapered outer surface 42, with the junction between the nozzle cone 38 and the valve stem 40 being defined by a continuous, annular groove or channel 44 formed in the valve element 36. As is best seen in FIGS. 5 and 6, the valve stem 40 of the valve element 36 is not of uniform outer diameter. Rather, when viewed from the perspective shown in FIGS. 5 and 6, the valve stem 40 includes a top flange portion 46 and a bottom flange portion 48 which each protrude radially outward relative to the remainder thereof. The top and bottom flange portions 46, 48 are separated from each other by a prescribed distance, with the bottom flange portion 48 extending to the channel 44. As also seen in FIGS. 5 and 6, the outer diameter of the bottom flange portion 48 is substantially equal to, but slightly less than, the diameter of the bottom section of the central bore 30.

In the nozzle assembly 10, the valve stem 40 of the valve element 36 is advanced through the central bore 30 such that the nozzle cone 38 predominately resides within the fluid chamber 20. The nozzle assembly 10 further comprises a helical biasing spring 50 which is disposed within the central bore 30 and circumvents a portion of the valve stem 40 extending therethrough. More particularly, as seen in FIGS. 5 and 6, the biasing spring 50 circumvents that portion of the outer surface of the valve stem 40 which extends between the top and bottom flange portions 46, 48 thereof. The biasing spring 50 is operative to normally bias the valve element 36 to its closed position shown in FIGS. 1, 2 and 5. A preferred material for both the nozzle housing 12 and the biasing spring 50 is Inconel 718, though other materials may be used without departing from the spirit and scope of the present invention.

The nozzle assembly 10 further comprises a nozzle guide nut 52 which is cooperatively engaged to the valve stem 40 of the valve element 36. When viewed from the perspective shown in FIGS. 2, 5 and 6, the nozzle guide nut 52 includes a generally cylindrical first, top portion 54 and a generally cylindrical second, bottom portion 56. The outer diameter of the top portion 54 exceeds that of the bottom portion 56, with the top and bottom portions 54, 56 being separated from each other by a continuous, annular groove or channel 58. The outer diameter of the bottom portion 56 is substantially equal to, but slightly less than, the diameter of the top section of the central bore 30. As such, the bottom portion 56 of the nozzle guide nut 52 is capable of being slidably advanced into the top section of the central bore 30.

The nozzle guide nut 52 further includes a bore which extends axially therethrough, and is sized to accommodate the advancement of a portion of the valve stem 40 through the nozzle guide nut 52. More particularly, as seen in FIGS. 5 and 6, the nozzle guide nut 52 is advanced over that portion of the valve stem 40 extending between the top flange portion 46 and the distal end of the valve stem 40 disposed furthest from the nozzle cone 38. Such advancement is limited by the abutment of a distal, annular rim 60 defined by the bottom portion 56 of the nozzle guide nut 52 against a complimentary shoulder defined by the top flange portion 46 of the valve stem 40. When such abutment occurs, the bore of the nozzle guide nut 52, the central bore 30 of the nozzle housing 12, and the valve stem 40 of the valve element 36 are coaxially aligned with each other.

In the nozzle assembly 10, the nozzle guide nut 52 is maintained in cooperative engagement to the valve stem 40 through the use of a locking nut 62 and a complimentary pair of lock washers 64. As seen in FIGS. 2, 5 and 6, the annular lock washers 64 are advanced over the valve stem 40, and effectively compressed and captured between the locking nut 62 and an annular end surface 65 defined by the top portion 54 of the nozzle guide nut 52. In this regard, a portion of the valve stem 40 proximate the distal end thereof is preferably externally threaded, thus allowing for the threadable engagement of the locking nut 62 thereto. The tightening of the locking nut 62 facilitates the compression and capture of the nozzle guide nut 52 between the lock washers 64 and top flange portion 46 of the valve stem 40.

Figure 3:
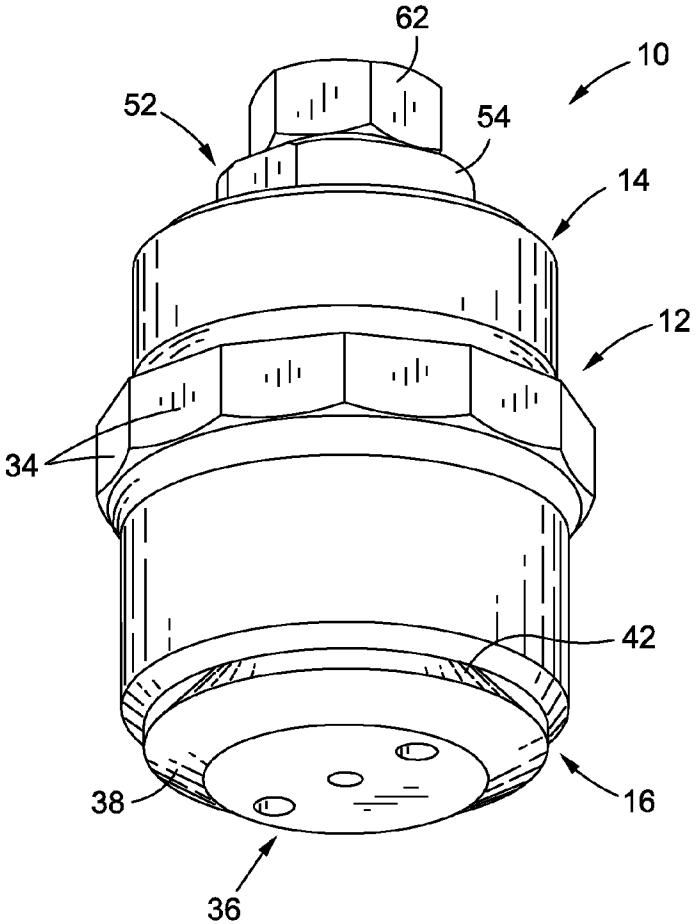
FIG. 3 is a bottom perspective view of the nozzle assembly of the present invention, depicting the valve element thereof in an open position.

As indicated above, the valve element 36 of the nozzle assembly 10 is selectively moveable between a closed position (shown in FIGS. 1, 2 and 5) and an open or flow position (shown in FIGS. 3, 4 and 6). When the valve element 36 is in either of its closed or open positions, the biasing spring 50 is confined or captured within the top section of the central bore 30, with one end of the biasing spring 50 being positioned against the shoulder 32 of the inner wall 26, and the opposite end of the biasing spring 50 being positioned against the rim 60 defined by the bottom portion 56 of the nozzle guide nut 52. Irrespective of whether the valve element 36 is in its closed or opened positions, at least the bottom portion 56 of the nozzle guide nut 52 remains or resides in the top section of the central bore 30 defined by the inner wall 26 of the nozzle housing 12. Similarly, at least a portion of the bottom flange portion 48 of the valve stem 40 remains within the bottom section of the central bore 30.

When the valve element 36 is in its closed position, a portion of the outer surface 42 of the nozzle cone 38 is firmly seated against the complimentary seating surface 22 defined by the nozzle housing 12, and in particular the outer wall 24 thereof. At the same time, a substantial portion of the bottom flange portion 48 of the valve stem 40 resides within the bottom section of the central bore 30, as does approximately half of the width of the channel 44 between the valve stem 40 and nozzle cone 38. Still further, while the bottom portion 56 of the nozzle guide nut 52 resides within the top section of the central bore 30, the channel 58 between the top and bottom sections 54, 56 of the nozzle guide nut 52 does not reside within the central bore 30, and thus is located exteriorly of the nozzle housing 12. As previously explained, the biasing spring 50 captured within the top section of the central bore 30 and extending between the rim 60 of the nozzle guide nut 52 and the shoulder 32 of the nozzle housing 12 acts against the nozzle guide nut 52 (and hence the valve element 36) in a manner which normally biases the valve element 36 to its closed position.

In the nozzle assembly 10, cooling water is introduced into each of the flow passage sections 18*a*, 18*b*, 18*c* at the top end 14 of the nozzle housing 12, and thereafter flows therethrough into the fluid chamber 20. When the valve element 36 is in its closed position, the seating of the outer surface 42 of the nozzle cone 36 against the seating surface 22 blocks the flow of fluid out of the fluid chamber 20 and hence the nozzle assembly 10. An increase of the pressure of the fluid beyond a prescribed threshold effectively overcomes the biasing force exerted by the biasing spring 50, thus facilitating the actuation of the valve element 36 from its closed position to its open position. More particularly, when viewed from the perspective shown in FIG. 6, the compression of the biasing spring 50 facilitates the downward axial travel of the nozzle guide nut 52 further into the top section of the central bore 30, and hence the downward axial travel of the valve element 36 relative to the nozzle housing 12. The downward axial travel of the nozzle guide nut 52 is limited by the abutment of a distal rim 66 of the inner wall 26 located at the top end 14 of the nozzle housing 12 against a complimentary shoulder 68 defined by the top portion 54 of the nozzle guide nut 52 proximate the channel 58.

When the valve element 36 is in its open position, the nozzle cone 38 thereof and that portion of the nozzle housing 12 defining the seating surface 22 collectively define an annular outflow opening between the fluid chamber 20 and the exterior of the nozzle assembly 12. The shape of such outflow opening, coupled with the shape of the nozzle cone 38, effectively imparts a conical spray pattern of small droplet size to the fluid flowing from the nozzle assembly 12. When the valve element 36 is in its open position, the bottom flange portion 48 of the valve stem 40 still resides within the bottom section of the central bore 30, though the channel 44 resides predominantly within the fluid chamber 20. Further, both the bottom portion 56 and channel 58 of the nozzle guide nut 52 reside within the top section of the central bore 30. As will be recognized, a reduction in the fluid pressure flowing through the nozzle assembly 10 below a threshold which is needed to overcome the biasing force exerted by the biasing spring 50 effectively facilitates the resilient return of the valve element 36 from its open position shown in FIG. 6 back to its closed position as shown in FIG. 5.

Importantly, fluid flow through the nozzle assembly 10, and in particular the flow passage sections 18*a*, 18*b*, 18*c* and fluid chamber 20 thereof, normally bypasses the central bore 30. As previously explained, the top section of the central bore 30 is effectively cut off from fluid flow by the advancement of the bottom portion 56 of the nozzle guide nut 52 into the top section of the central bore 30 proximate the rim 66 of the inner wall 26 irrespective of whether the valve element 36 is in its closed or open positions, and the positioning of the bottom flange portion 48 of the valve stem 40 within the bottom section of the central bore 30 irrespective of whether the valve element 36 is in its open or closed positions. As a result, fluid flowing through the nozzle assembly 10 does not directly impinge the biasing spring 50 residing within the top section of the central bore 30. Thus, even when the nozzle assembly 10 heats up to full steam temperature when no water is flowing and is shocked when impinged with cold water, the level of thermal shocking of the biasing spring 50 will be significantly reduced, thereby lengthening the life thereof and minimizing occurrences of spring breakage. Further, as is most apparent from FIGS. 2, 4 and 7, the inflow ends of the flow passage sections 18*a*, 18*b*, 18*c* at the top end 14 of the nozzle housing 14 are radiused, which increases the capacity thereof. This shape of the inflow ends is a result of the use of the DMLS or casting process described above to facilitate the fabrication of the nozzle housing 12.

In addition, in the nozzle assembly 10, the travel of the valve element 36 from its closed position to its open position is limited mechanically by the abutment of the shoulder 68 of the nozzle guide nut 52 against the rim 66 of the inner wall 26 of the nozzle housing 12 in the above-described manner. This mechanical limiting of the travel of the valve element 36 eliminates the risk of compressing the biasing spring 50 solid, and further allows for the implementation of precise limitations to the maximum stress level exerted on the biasing spring 50, thereby allowing for more accurate calculations of the life cycle thereof. Still further, the aforementioned mechanical limiting of the travel of the valve element 36 substantially increases the pressure limit of the nozzle assembly 10 since it is not limited by the compression of the biasing spring 50. This also provides the potential to fabricate the nozzle assembly 10 in a smaller size to function at higher pressure drops, and to further provide better primary atomization with higher pressure drops. The mechanical limiting of the travel of the valve element 36 also allows for the tailoring of the flow characteristics of the nozzle assembly 10, with the cracking pressure being controlled through the selection of the biasing spring 50.

Figure 9:
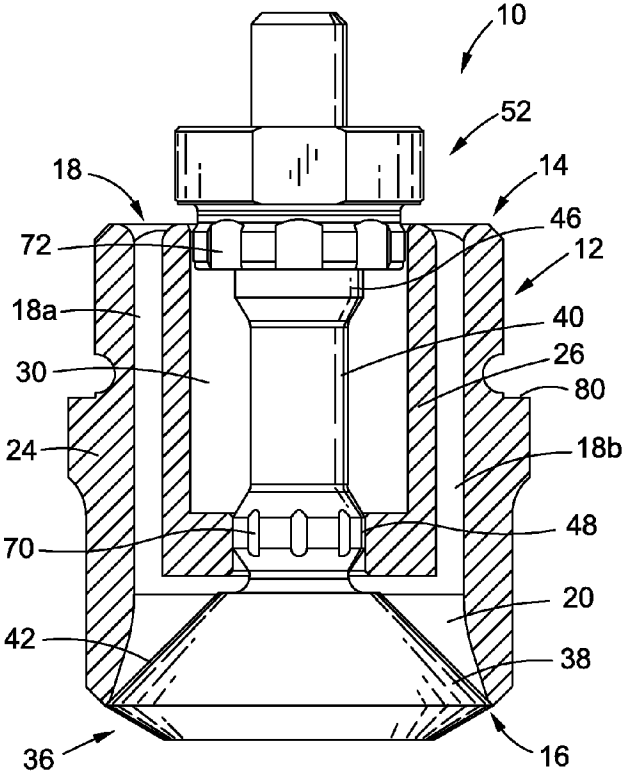
FIG. 9 is cross-sectional view of a variant of the nozzle assembly of the present invention wherein the valve element thereof is provided with debris grooves in a prescribed arrangement therein.

Referring now to FIG. 9, it is contemplated that the valve element 36 and the nozzle guide nut 52 of the nozzle assembly 10 may optionally be provided with additional structural features which are specifically adapted to prevent any undesirable sticking of the valve element 36 during the reciprocal movement thereof between its closed and open positions. More particularly, it is contemplated that the bottom flange portion 48 of the valve stem 40 of the valve element 36 may include a series of elongate debris grooves 70 formed in the outer peripheral surface thereof, preferably in prescribed, equidistantly spaced intervals. As is apparent from FIG. 9, the debris grooves 70 circumvent the entire periphery of the bottom flange portion 48, and each extend in spaced, generally parallel relation to the axis of the stem portion 40.

Similarly, the bottom portion 56 of the nozzle guide nut 52 may include a series of debris grooves 72 within the peripheral outer surface thereof, preferably in prescribed, equidistantly spaced intervals. The debris grooves 72 circumvent the entire periphery of the bottom portion 56, and each extend in spaced, generally parallel relation to the axis of the bore of the nozzle guide nut 52, and hence the axis of the valve stem 40 of the valve element 32.

When the valve element 32 is in either its closed position (as shown in FIG. 9) or its open position, the debris grooves 70, 72 effectively reduce the contact area between the nozzle guide nut 52 and the nozzle housing 12, and further between the valve element 36 and the nozzle housing 12, as reduces the likelihood of the valve element 36 sticking as a result of foreign particles. Though the debris grooves 70, 72 may allow for some measure of the flow of cooling water into the top section of the central bore 30 and hence into contact with the biasing spring 50 therein, the amount of cooling water flowing into the top section of the central bore 30 is still insufficient to thermally shock the biasing spring 50. The inclusion of the debris grooves 70, 72 is particularly advantageous in those applications wherein the nozzle assembly 10 may be integrated into a system wherein large amounts of particulates are present in the cooling water.

Figure 10:
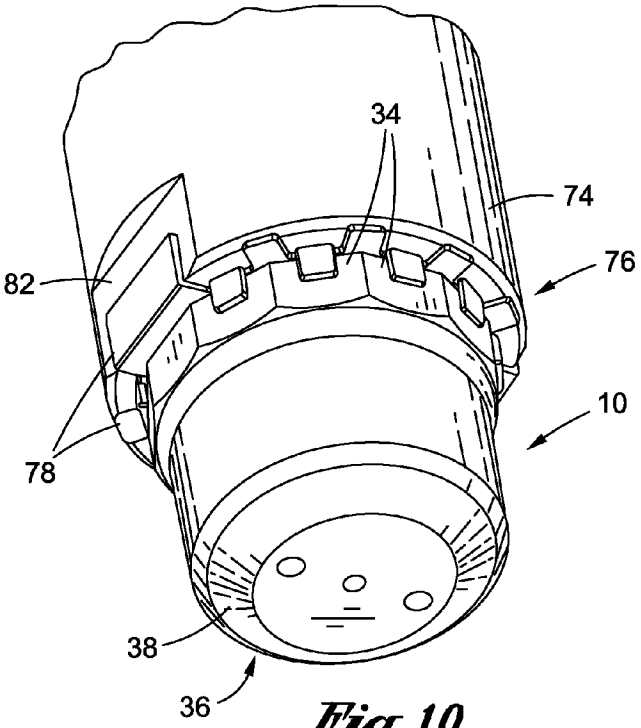
FIG. 10 is a bottom perspective view of the nozzle assembly of the present invention as partially inserted into a complementary nozzle holder and retained therein via a tab washer.
Figure 11:
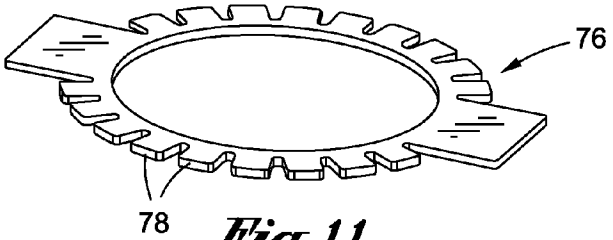
FIG. 11 is a top perspective view of the tab washer shown in FIG. 10 in an original, unbent state.

Referring now to FIGS. 10 and 11, in a conventional application, the nozzle assembly 10 is cooperatively engaged to a complimentary nozzle holder 74. As indicated above, thermal cycling, as well as the high velocity head of steam passing through an attemperator including the nozzle assembly 10, can potentially lead to the loosening thereof within the nozzle holder 74 resulting in an undesirable change in the orientation of the spray angle of cooling water flowing from the nozzle assembly 10. To prevent any such rotation of the nozzle assembly 10 relative to the nozzle holder 74, it is contemplated that the nozzle assembly 10 may be outfitted with a tab washer 76 which is shown in FIG. 11 in an original, unbent state. The tab washer 76 has an annular configuration and defines a multiplicity of radially extending tabs 78 which are arranged about the periphery thereof. As is apparent from FIG. 11, one diametrically opposed pair of the tabs 78 is enlarged relative to the remaining tabs 78.

When used in conjunction with the nozzle assembly 10, the tab washer 76, in its originally unbent state, is advanced over a portion of the nozzle housing 12 and rested upon an annular shoulder 80 which is defined thereby and extends in generally perpendicular relation to the above-described flats 34. Thereafter, upon the advancement of the nozzle assembly 10 into the nozzle holder 74, the enlarged tabs 78 of the tab washer 76 are bent in the manner shown in FIG. 10 so as to extend partially along and in substantially flush relation to respective ones of a corresponding pair of flats 82 formed in the outer surface of the nozzle holder 74 in diametrically opposed relation to each other. Of the remaining tabs 78 of the tab washer 76, every other such tab 78 is bent in a direction opposite those engaged to the flats 82 so as to extend along and in substantially flush relation to corresponding ones of the flats 34 defined by the nozzle housing 12. The bending of the tab washer 76 into the configuration shown in FIG. 10 effectively prevents any rotation of loosening of the nozzle assembly 10 relative to the nozzle holder 74. Along these lines, though not shown in FIGS. 1-9, it is contemplated that the portion of the outer surface of the housing 12 extending between the shoulder 80 and the top end 14 will be externally threaded as allows for the threadable engagement of the nozzle assembly 10 to complementary threads formed within the interior of the nozzle holder 74. In this regard, the nozzle assembly 10 and the nozzle holder 74 are preferably threadably connected to each other, with the loosening of this connection as could otherwise be facilitated by the rotation of the nozzle assembly 10 relative to the nozzle holder 74 being prevented by the aforementioned tab washer 76.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. A nozzle assembly for a desuperheating device configured for spraying cooling water, the nozzle assembly comprising:

a nozzle housing having an outer wall and an inner wall concentrically positioned within the outer wall and defining a central bore, the nozzle housing defining a seating surface and having a flow passage extending therethrough;

a valve element movably attached to the nozzle housing and selectively movable between closed and open positions relative thereto, a portion of the valve element being seated against the seating surface in a manner blocking fluid flow through the fluid passage and out of the nozzle assembly when the valve element is in the closed position, with portions of the nozzle housing and the valve element collectively defining an outflow opening which facilities fluid flow through the flow passage and out the nozzle assembly when the valve element is in the open position;

a biasing spring disposed within the nozzle housing and cooperatively engaged to the valve element, the biasing spring being operative to normally bias the valve element to the closed position; and a nozzle guide which is cooperatively engaged to the valve element and partially resides within the central bore when the valve element is in both the closed and open positions, the biasing spring being abutted against and extending between portions of the nozzle guide and the inner wall;

wherein the nozzle housing is sized and configured such that the biasing spring disposed therein is effectively shielded from direct impingement of cooling water flowing through the flow passage.

2. The nozzle assembly of claim 1 wherein the nozzle housing defines a fluid chamber which is circumvented by the seating surface and fluidly communicates with the flow passage, and the flow passage has a generally annular configuration which circumvents the biasing spring and at least a portion of the valve element.

3. The nozzle assembly of claim 2 wherein the flow passage comprises three separate flow passage segments which each fluidly communicate with the fluid chamber and each span an circumferential interval of approximately 120°.

4. The nozzle assembly of claim 2 wherein the central bore fluidly communicates with the fluid chamber;

the flow passage and the fluid chamber each being collectively defined by portions of the outer and inner walls, with the biasing spring and a portion of the valve element residing within the central bore.

5. The nozzle assembly of claim 4 wherein the valve element comprises:

a nozzle cone which is seated against the seating surface when the valve element is in the closed position, and partially defines the outflow opening when the valve element is in the open position; and an elongate valve stem which extends axially from the nozzle cone;

a portion of the valve stem being circumvented by the biasing spring and residing within the central bore of the nozzle housing.

6. The nozzle assembly of claim 1 wherein:

the inner wall of the nozzle housing defines a distal rim which circumvents one end of the central bore defined thereby; and the nozzle guide defines an annular shoulder which is sized and configured to abut the distal rim of the inner wall when the valve element is in the open position.

7. The nozzle assembly of claim 6 wherein the valve element comprises:

a nozzle cone which is seated against the seating surface when the valve element is in the closed position, and partially defines the outflow opening when the valve element is in the open position; and an elongate valve stem which extends axially from the nozzle cone and through the central bore;

a portion of the valve stem having the nozzle guide cooperatively engaged thereto, and being circumvented by the biasing spring.

8. The nozzle assembly of claim 7 wherein the valve stem of the valve element comprises:

a radially extending first flange portion; and a radially extending second flange portion disposed in spaced relation to the first flange portion;

the biasing spring circumventing the valve stem between the first and second flange portions thereof, with the nozzle guide being abutted against the first flange portion.

9. The nozzle assembly of claim 8 wherein:

the central bore includes a first section which is of a first diameter and a second section which extends to the fluid chamber and is of a second diameter less than the first diameter;

the biasing spring and a portion of the nozzle guide nut reside in the first section of the central bore when the valve element is in either of its closed and open positions; and the second flange portion of the valve stem at least partially resides within the second section of the central bore when the valve element is in either of its closed and open positions.

10. The nozzle assembly of claim 8 wherein:

the portion of the nozzle guide residing in the first section of the central bore has a plurality of debris grooves formed therein and in direct fluid communication with the central bore; and the second flange portion of the valve stem has a plurality of debris grooves formed therein and in direct fluid communication with the central bore.

11. A nozzle assembly for a desuperheating device configured for spraying cooling water, the nozzle assembly comprising:

a nozzle housing having a flow passage extending therethrough;

a valve element movably attached to the nozzle housing and selectively movable between closed and open positions relative thereto;

a biasing spring disposed within the nozzle housing and cooperatively engaged to the valve element; and a nozzle guide coupled to the valve element so as to move with the valve element as the valve element transitions between the closed and open positions, the nozzle guide being configured and positioned relative to the valve element and nozzle housing so as to partially reside within the nozzle housing when the valve element is in both the closed and open positions;

wherein the nozzle housing is sized and configured such that the biasing spring disposed therein is effectively shielded from direct impingement of cooling water flowing through the flow passage.

12. The nozzle assembly of claim 11 wherein the nozzle housing defines a fluid chamber which fluidly communicates with the flow passage, and the flow passage has a generally annular configuration which circumvents the biasing spring and at least a portion of the valve element.

13. The nozzle assembly of claim 12 wherein the nozzle housing comprises:

an outer wall; and an inner wall which is concentrically positioned within the outer wall and defines a central bore which fluidly communicates with the fluid chamber;

the flow passage and the fluid chamber each being collectively defined by portions of the outer and inner walls, with the biasing spring and a portion of the valve element residing within the central bore.

14. The nozzle assembly of claim 13 wherein the valve element comprises:

a nozzle cone; and an elongate valve stem which extends axially from the nozzle cone;

a portion of the valve stem being circumvented by the biasing spring and residing within the central bore of the nozzle housing.

15. The nozzle assembly of claim 11 wherein:

the inner wall of the nozzle housing defines a distal rim which circumvents one end of the central bore defined thereby; and the nozzle guide defines an annular shoulder which is sized and configured to abut the distal rim of the inner wall when the valve element is in the open position.

16. The nozzle assembly of claim 15 wherein the valve stem of the valve element comprises:

a radially extending first flange portion; and a radially extending second flange portion disposed in spaced relation to the first flange portion;

the biasing spring circumventing the valve stem between the first and second flange portions thereof, with the nozzle guide being abutted against the first flange portion.

17. The nozzle assembly of claim 16 wherein:

the central bore includes a first section which is of a first diameter and a second section which extends to the fluid chamber and is of a second diameter less than the first diameter;

the biasing spring and a portion of the nozzle guide reside in the first section of the central bore when the valve element is in either of its closed and open positions; and the second flange portion of the valve stem at least partially resides within the second section of the central bore when the valve element is in either of its closed and open positions.

18. The nozzle assembly of claim 17 wherein:

the portion of the nozzle guide residing in the first section of the central bore has a plurality of debris grooves formed therein and in direct fluid communication with the central bore; and the second flange portion of the valve stem has a plurality of debris grooves formed therein.

19. The nozzle assembly of claim 10, wherein the nozzle guide is disposed about an axis, the plurality of debris grooves formed on the nozzle guide extending generally linearly in a direction parallel to the axis.

20. The nozzle assembly of claim 10, wherein the plurality of debris grooves formed on the second flange portion of the valve stem are axial grooves.

* * * * *